US007972176B2

(12) United States Patent
Burris et al.

(10) Patent No.: US 7,972,176 B2
(45) Date of Patent: Jul. 5, 2011

(54) HARDLINE COAXIAL CABLE CONNECTOR

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 62 days.

(21) Appl. No.: 12/502,633

(22) Filed: Jul. 14, 2009

(65) Prior Publication Data

US 2010/0022125 A1 Jan. 28, 2010

Related U.S. Application Data

(60) Provisional application No. 61/082,964, filed on Jul. 23, 2008.

(51) Int. Cl.
*H01R 9/05* (2006.01)

(52) U.S. Cl. ..... 439/584

(58) Field of Classification Search ..... 439/583, 439/584

See application file for complete search history.

(56) References Cited

U.S. PATENT DOCUMENTS

| | | | | |
|---|---|---|---|---|
| 3,537,065 | A * | 10/1970 | Winston | 439/584 |
| 4,575,274 | A * | 3/1986 | Hayward | 403/2 |
| 4,854,893 | A * | 8/1989 | Morris | 439/578 |
| 4,923,412 | A | 5/1990 | Morris | 439/578 |
| 6,808,415 | B1 | 10/2004 | Montena | 439/584 |
| 6,884,113 | B1 | 4/2005 | Montena | 439/578 |
| 2003/0135999 | A1 | 7/2003 | Khemakhem et al. | 29/857 |
| 2004/0142596 | A1 | 7/2004 | Henningsen | 439/584 |
| 2007/0155233 | A1 | 7/2007 | Laerke et al. | 439/578 |

* cited by examiner

*Primary Examiner* — Neil Abrams
(74) *Attorney, Agent, or Firm* — Matthew J. Mason

(57) ABSTRACT

A hardline coaxial cable connector includes a body subassembly, a back nut subassembly and a deformable ferrule disposed within the back nut subassembly. The back nut subassembly is rotatable with respect to the body subassembly and a coaxial cable inserted therein. Axial advancement of the back nut subassembly toward the body subassembly causes the ferrule to deform radially inwardly.

19 Claims, 12 Drawing Sheets

HARDLINE COAXIAL CABLE CONNECTOR

CROSS-REFERENCE TO RELATED APPLICATIONS

This application claims the benefit of, and priority to U.S. Provisional Patent Application No. 61/082,964 filed on Jul. 23, 2008 entitled, "Hardline Coaxial Cable Connector", the content of which is relied upon and incorporated herein by reference in its entirety.

BACKGROUND OF THE INVENTION

1. Field of the Invention

The present invention relates generally to coaxial cable connectors, and particularly to connectors for use with hardline coaxial cables.

2. Technical Background

A hardline coaxial cable typically has a solid center conductor surrounded by a plastic or other dielectric material and encased within an electrically conductive solid outer conductor that may be surrounded by an outer insulative jacket. In application, each end of the cable can be terminated by a connector, which serves to electrically and mechanically engage the cable conductors to communicate signals transmitted therethrough and for gripping the outer conductor to physically secure the cable and prevent detachment during normal operation.

Historically, connectors for hardline coaxial cables have been designed to grip the cable in such a manner as to be removed from the cable at a later time if so desired. Such a feature is generally known as "re-usability." Connectors with this capability are typically constructed of a relatively large number of components (e.g., 12 or 13 components excluding o-rings), are comparatively expensive, and many times fail to release from the cable outer conductor when so desired.

Continued advances in the state of the art have led to a general trend of cost reduced designs along with challenges to certain requirements such as re-usability. Specifically, it has been determined that it may be preferable for a connector to be "re-enterable" as opposed to reusable. In order to be re-enterable, the connector must be capable of being installed on a cable and be further capable of termination with a device or piece of equipment and, at a later time, allow access to the equipment by uncoupling the connector. The connector does not have to be removable from the cable in order to be re-enterable.

SUMMARY OF THE INVENTION

One aspect of the invention includes a hardline coaxial cable connector for coupling a coaxial cable having a center conductor, an insulative layer, and an outer conductor to an equipment port. The hardline connector includes a body subassembly having a first end and a second end, the first end adapted to connect to an equipment port and the second end having internal or external threads. The connector also includes a detachable back nut subassembly having a first end, a second end, and an inner surface, the first end having threads that mate with the internal or external threads on the second end of the body subassembly and the second end adapted to receive a prepared end of a coaxial cable. In addition, the connector includes a deformable ferrule disposed within the back nut subassembly. The back nut subassembly is rotatable with respect to a coaxial cable inserted therein. The inner surface of the back nut subassembly includes a tapered portion that decreases from a first diameter between the tapered portion and the first end of the back nut subassembly to a second diameter between the tapered portion and a second end of the back nut subassembly such that as the back nut subassembly is advanced axially toward the body subassembly as a result of the mating of the internal or external threads of the body subassembly with the threads of the back nut subassembly and rotating the back nut subassembly relative to the body subassembly, the tapered portion contacts the deformable ferrule and causes at least a portion of the ferrule to deform radially inwardly.

In another aspect, the invention includes a method of coupling a hardline coaxial cable having a center conductor, an insulative layer, and an outer conductor to an equipment port. The method includes providing a hardline coaxial cable connector that includes a body subassembly having a first end and a second end, the first end adapted to connect to the equipment port and the second end having internal or external threads. The hardline coaxial cable connector also includes a detachable back nut subassembly having a first end, a second end, and an inner surface, the first end having threads that mate with the internal or external threads on the second end of the body subassembly and the second end adapted to receive a prepared end of a coaxial cable. In addition, the hardline coaxial cable connector includes a deformable ferrule disposed within the back nut subassembly. Next, the method includes connecting the first end of the body subassembly to the equipment port and inserting the prepared end of a coaxial cable into the second end of the removable back nut subassembly. The method also includes rotating the back nut subassembly relative to the coaxial cable and the body subassembly such that the back nut subassembly is advanced axially toward the body subassembly as a result of the mating of the internal or external threads of the body subassembly with the threads of the back nut subassembly. The inner surface of the back nut subassembly includes a tapered portion that decreases from a first diameter between the tapered portion and the first end of the back nut subassembly to a second diameter between the tapered portion and a second end of the back nut subassembly such that as the back nut subassembly is advanced axially toward the body subassembly, the tapered portion contacts the deformable ferrule and causes at least a portion of the ferrule to deform radially inwardly against the outer conductor of the coaxial cable in order to provide electrical and mechanical communication between the ferrule and the outer conductor.

In yet another aspect, the invention includes further decoupling a hardline coaxial cable having a center conductor, an insulative layer, and an outer conductor from an equipment port, following the method of coupling described above. The method of decoupling includes detaching the back nut subassembly from the body subassembly by rotating the back nut subassembly relative to the coaxial cable and the body subassembly such that the back nut subassembly is advanced axially away from the body subassembly as a result of the mating of the internal or external threads of the body subassembly with the threads of the back nut subassembly. The electrical and mechanical communication between said ferrule and said outer conductor is maintained upon detachment of the back nut subassembly from the body subassembly.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
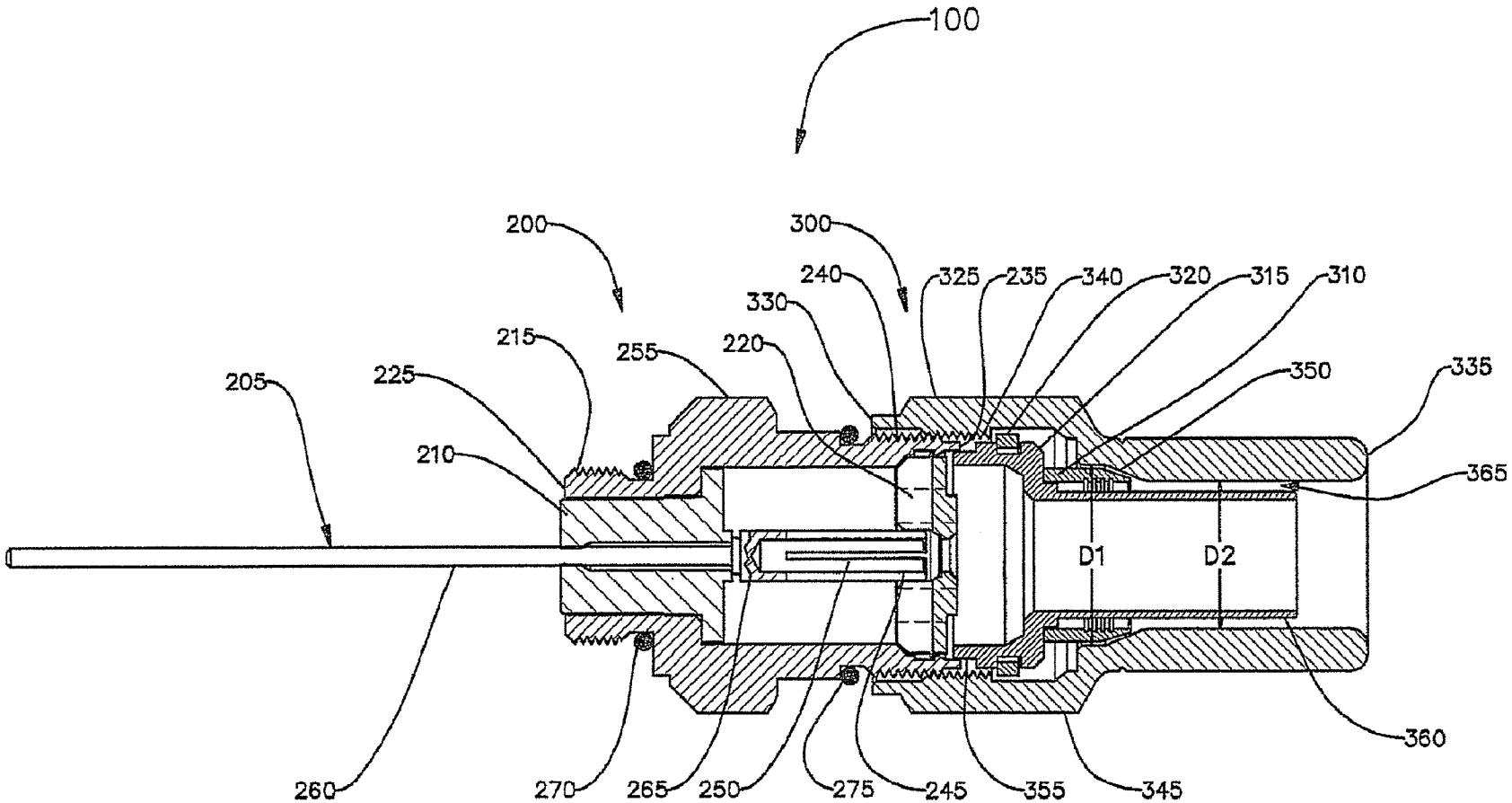
FIG. 1 is a side cutaway view along the centerline of a preferred embodiment of a connector, as disclosed herein, comprising a body subassembly and a back nut subassembly illustrated in the "as shipped" condition ready for installation onto a prepared coaxial cable.

Reference will now be made in detail to the present preferred embodiments of the invention, examples of which are illustrated in the accompanying drawings. Whenever possible, the same reference numerals will be used throughout the drawings to refer to the same or like parts.

Referring to FIG. 1, connector 100 includes a body subassembly 200 and back nut subassembly 300. Body subassembly 200 includes body 215 made from electrically conductive material, preferably metal such as aluminum, and has a first end 225 adapted to connect to an equipment port (see FIG. 3) and a second end 235 having external threads 240. Body 215 is preferably a generally cylindrical, unitary piece and preferably has a outwardly radially extending area 255 with an outer configuration (such as a hex configuration) that allows the body subassembly 200 to be attached to and tightened on an equipment port using a standard tool, such as a wrench. Body subassembly 200 preferably houses pin 205 made from electrically conductive material, preferably metal, such as tin-plated brass. Pin 205 has a front end 260 for connecting to an equipment port and a back end 265, the back end having a socket contact 245 for receiving the center conductor of a coaxial cable. Socket contact 245 preferably includes a plurality of cantilevered tines 250. Body subassembly 200 also preferably houses insulator 210 made from electrically non-conductive material, preferably plastic such as polycarbonate, and actuator 220 made from electrically non-conductive material, preferably plastic such as polyimide thermoplastic resins of, for example, amorphous polyetherimide also known as Ultem®. Body subassembly 200 may optionally include o-rings 270 and/or 275.

Figure 3:
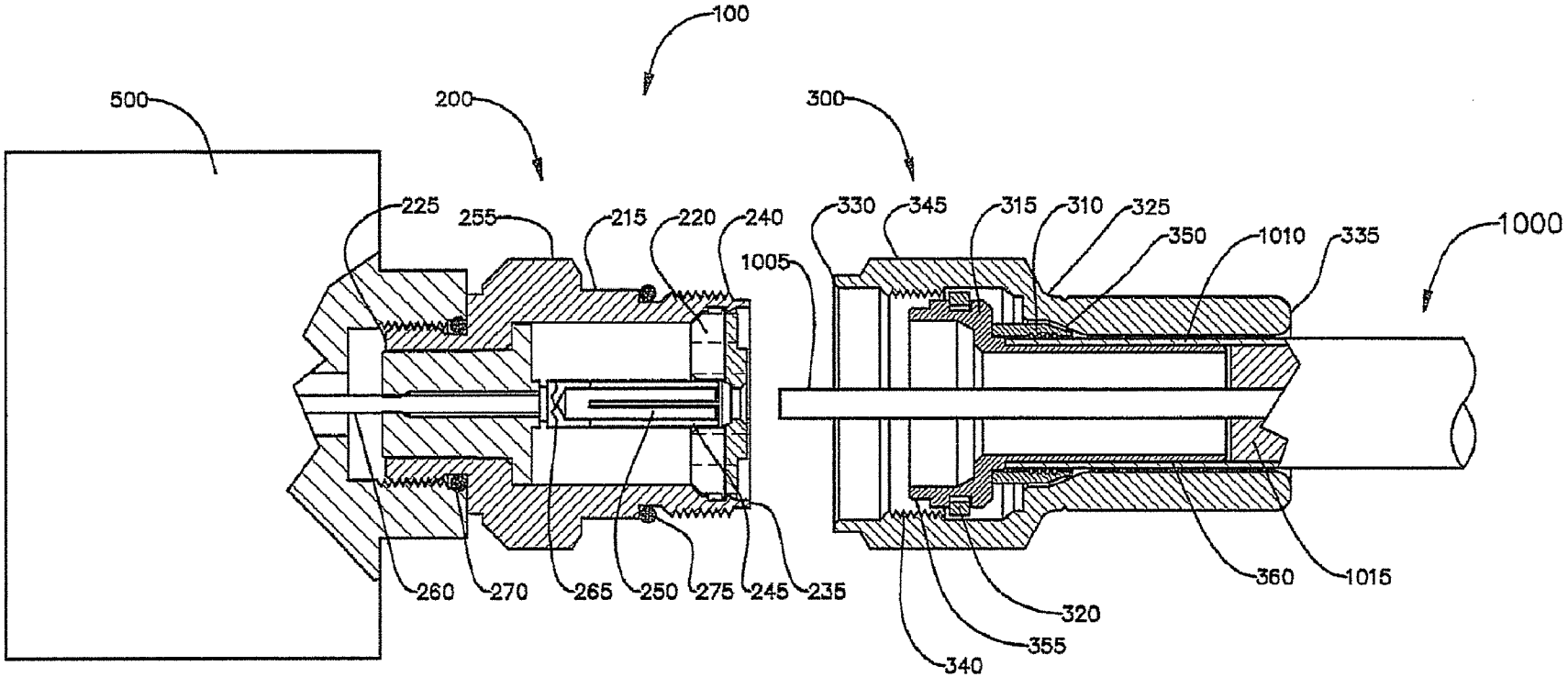
FIG. 3 is a side cutaway view along the centerline of a preferred embodiment of a connector, as disclosed herein, comprising a body subassembly and a back nut subassembly illustrated in a partially installed condition.

Back nut subassembly 300 includes back nut 325 made from electrically conductive material, preferably metal such as aluminum, and has a first end 330 having internal threads 340 adapted to mate with external threads 240 and a second end 335 adapted to receive a prepared end of a coaxial cable (see FIG. 3). The inner surface of back nut 325 includes a tapered portion 350 that decreases in diameter from a first diameter D1 between the tapered portion 350 and the first end 330 of the back nut subassembly 300 to a second diameter D2 between the tapered portion 350 and the second end 335 of the back nut subassembly 300. Back nut 325 is preferably a generally cylindrical, unitary piece and preferably has an outwardly radially extending area 345 with an outer configuration (such as a hex configuration) that allows the back nut subassembly 300 to be attached to and tightened on to body subassembly 200 using a standard tool, such as a wrench. Back nut subassembly 300 houses deformable ferrule 310 made from electrically conductive and malleable material, preferably metal, such as aluminum or, alternately, tin-plated brass. Ferrule 310 preferably has an outer diameter that is less than first diameter D1 and greater than second diameter D2. Inner diameter of ferrule 310 may optionally have grooves and ridges to enhance gripping of an outer conductor of a coaxial cable. Back nut subassembly 300 also preferably houses sleeve 315 preferably made from electrically conductive material, preferably metal such as aluminum. Alternatively, sleeve 315 can be made from a plastic material. Sleeve 315 is preferably a generally cylindrical unitary piece and preferably has an increased diameter front end 355 and a decreased diameter back end 360 wherein the outer diameter of back end 360 is less than second diameter D2 such that an annular gap 365 extends between outer diameter of back end 360 and second diameter D2. Outer diameter of back end 360 is also preferably less than inner diameter of ferrule 310 such that annular gap 365 also extends between outer diameter of back end 360 and inner diameter of ferrule 310. Back nut subassembly 300 may optionally include retaining ring 320.

Figure 2:
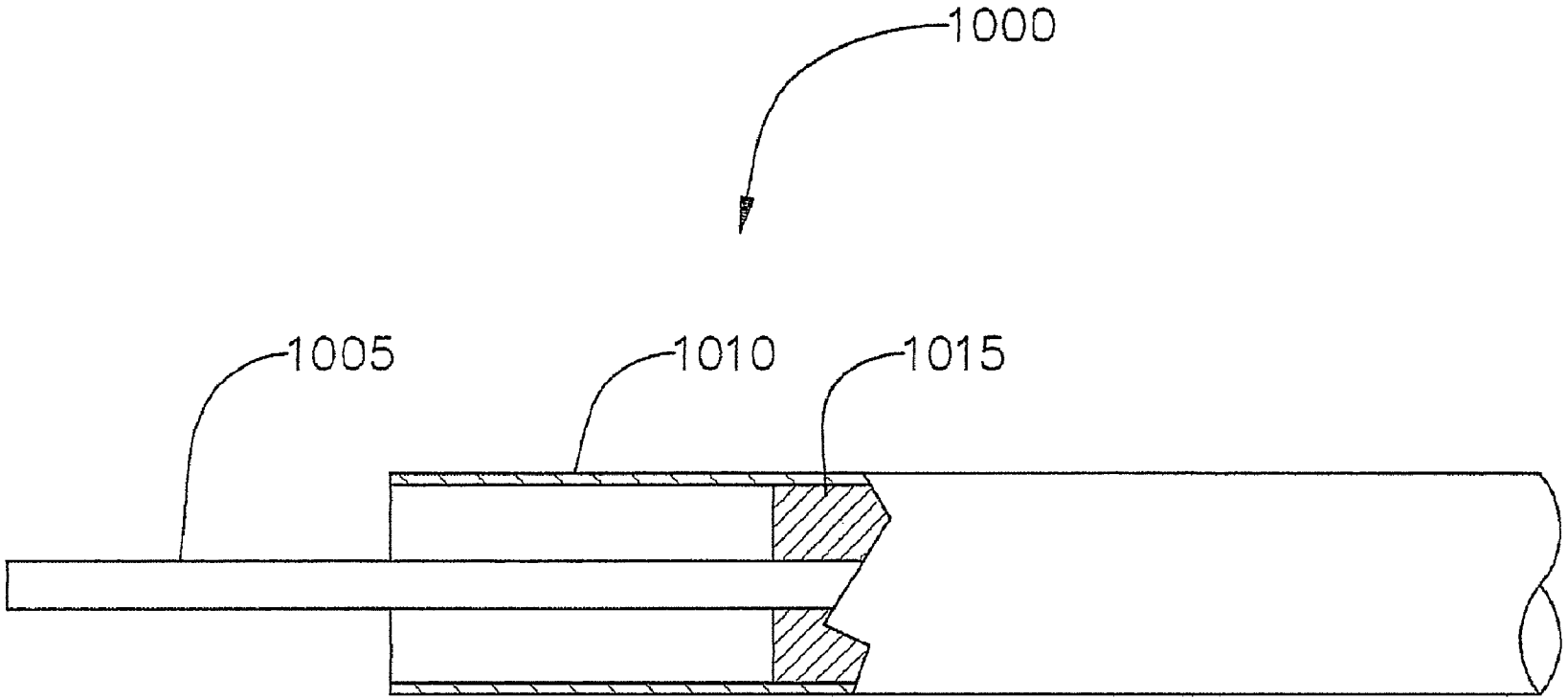
FIG. 2 is a side cutaway view along the centerline of the prepared end of a hardline coaxial cable.

Turning to FIG. 2, a prepared end of a hardline coaxial cable 1000 is shown. Coaxial cable 1000 includes center conductor 1005 made from electrically conductive material, preferably metal such as copper clad aluminum, outer conductor 1010 made from electrically conductive material, preferably metal such as aluminum, and insulative layer 1015 made from electrically non-conductive material, preferably foamed polyethylene plastic.

FIG. 3 illustrates an embodiment where the back nut subassembly 300 is detached from the body subassembly 200, wherein the first end 225 of the body subassembly 200 has been attached to an equipment port 500 and a prepared end of a coaxial cable 1000 has been inserted into the second end 335 of the back nut subassembly 300. For example, in a preferred embodiment, the connector 100 is shipped in the configuration shown in FIG. 1, after which the installer detaches the back nut subassembly 300 from the body subassembly 200. Next, the installer attaches the first end 225 of the body subassembly 200 to an equipment port 500 and inserts the prepared end of a coaxial cable 1000 into the second end 335 of the back nut subassembly 300. Preferably, back nut subassembly houses sleeve 315 such that outer conductor 1010 of coaxial cable 1000 is inserted in annular gap 365 between back end 360 of sleeve 315 and second diameter D2 and between back end 360 of sleeve 315 and inner diameter of ferrule 310. At this point, the back nut subassembly 300, housing the prepared end of coaxial cable 1000, is ready to be reattached to the body subassembly 200.

Figure 4:
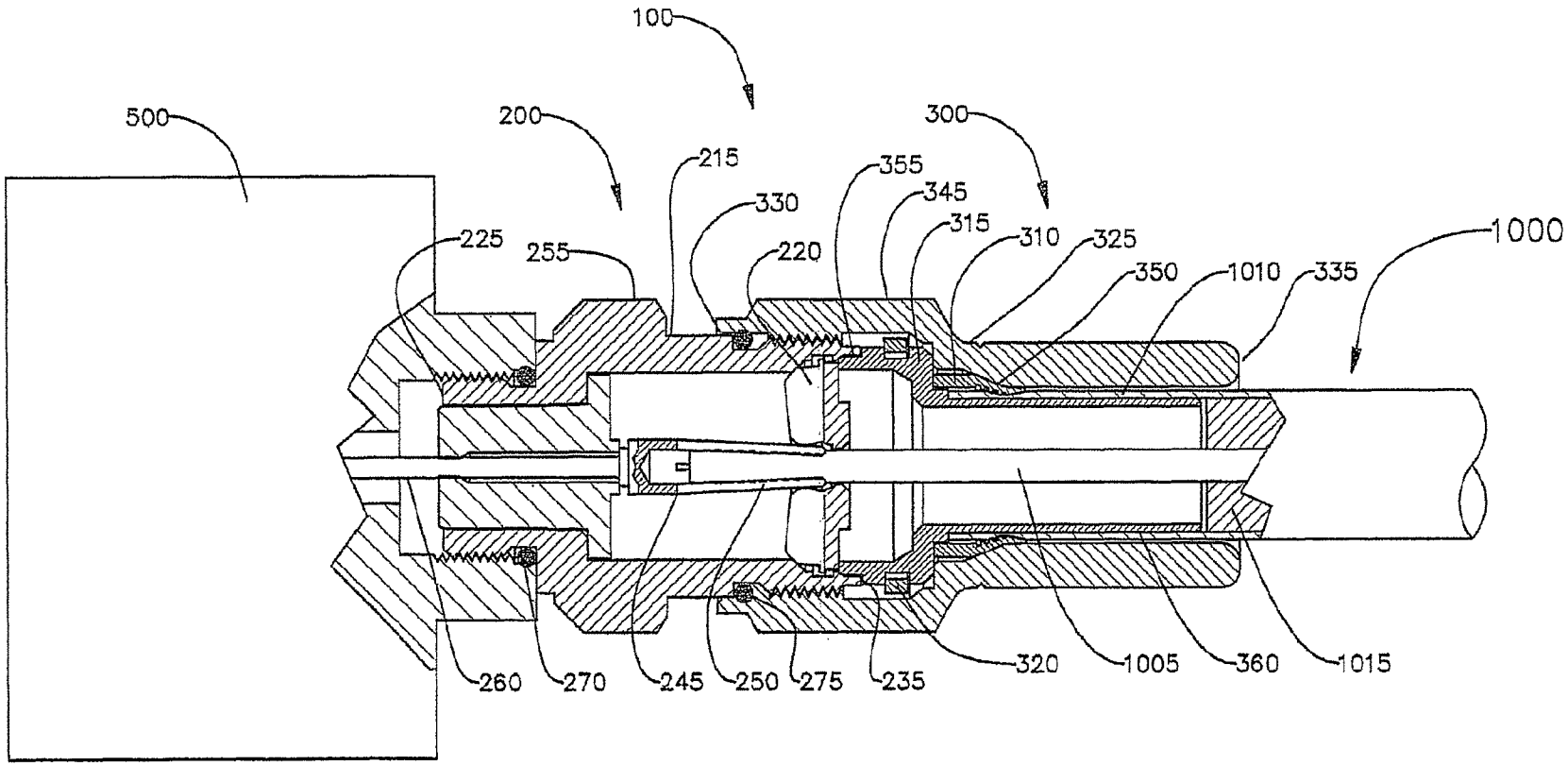
FIG. 4 is a side cutaway view along the centerline of a preferred embodiment of a connector, as disclosed herein, comprising a body subassembly and a back nut subassembly illustrated in a fully installed condition.

FIG. 4 illustrates connector 100 wherein back nut subassembly 300 has been fully installed and tightened on body subassembly 200. The back nut subassembly 300 including back nut 325 is rotatable with respect to both the body subassembly 200 and the coaxial cable 1000 inserted therein. As the back nut subassembly 300 is advanced axially toward the body subassembly 200 as a result of the mating of the external threads 240 of the body subassembly 200 with the internal thread 340 of the back nut subassembly 300 and rotating the back nut subassembly 300 relative to the body subassembly 200 and coaxial cable 1000, tapered portion 350 contacts deformable ferrule 310 and causes at least a portion of the ferrule 310 to deform radially inwardly as shown in FIG. 4. As ferrule 310 deforms radially inwardly against outer conductor 1010 of coaxial cable 1000, a gripping and sealing relationship is established between ferrule 310 and outer conductor 1010 providing electrical and mechanical communication between ferrule 310 and outer conductor 1010. Back nut subassembly 300 preferably houses sleeve 315 such that as the ferrule deforms radially inwardly against outer conductor 1010, at least a portion of outer conductor 1010 that is inserted between the outer diameter of back end 360 of sleeve 315 and inner diameter of ferrule 310 is clamped between the sleeve 315 and the ferrule 310 as shown in FIG. 4. Meanwhile, center conductor 1005 is received in socket contact 245 and, in a preferred embodiment, axial advancement of sleeve 315 toward actuator 220 causes actuator 220 to drive cantilevered tines 250 radially inward against center conductor 1005.

Figure 5:
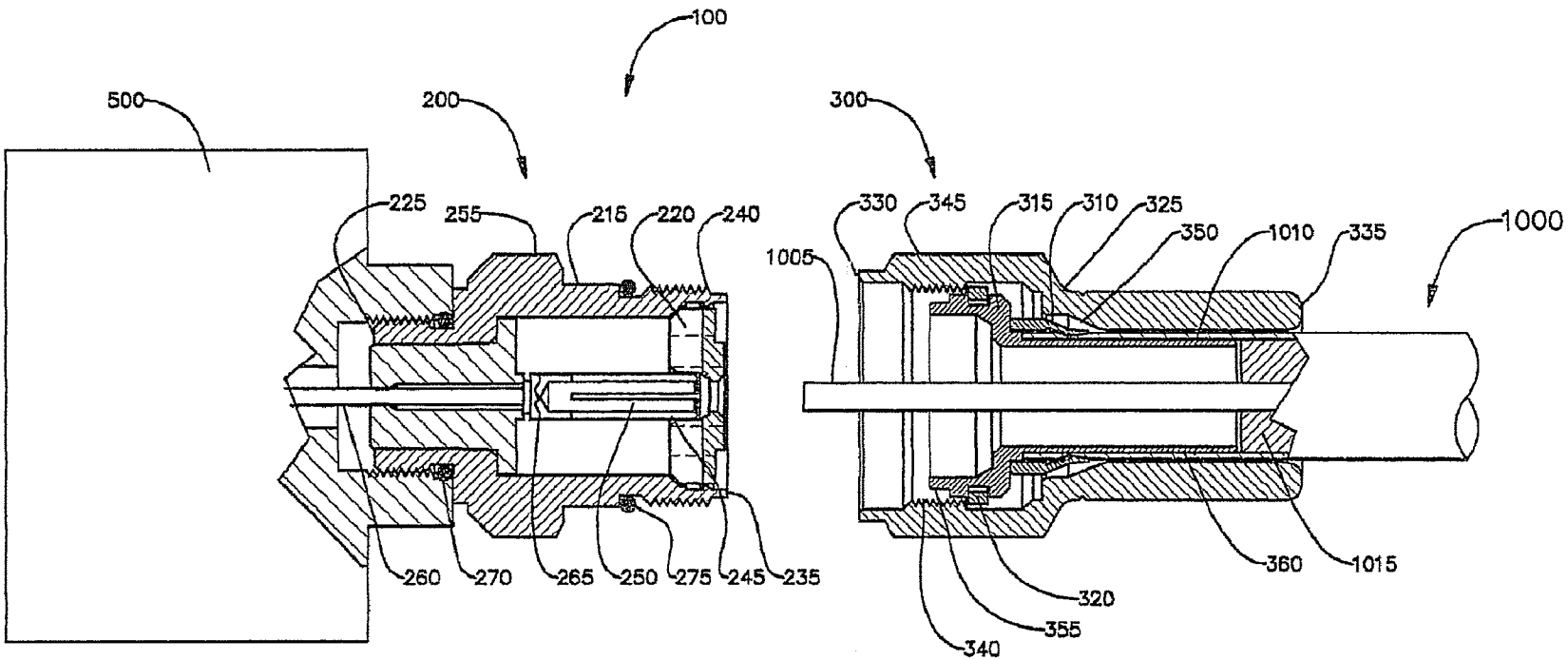
FIG. 5 is a side cutaway view along the centerline of a preferred embodiment of a connector, as disclosed herein, comprising a body subassembly and a back nut subassembly illustrated as fully installed and then separated condition.

FIG. 5 shows connector 100 in the re-enterable state wherein back nut subassembly 300 has been detached from body subassembly 200 and body subassembly 200 remains installed in equipment port 500. Back nut subassembly 300 is detached from body subassembly 200 by rotating the back nut 325 relative to the coaxial cable 1000 and body subassembly 200 such that the back nut subassembly 300 is advanced axially away from the body subassembly 200 as a result of the mating of the external threads 240 of the body subassembly 200 with the internal threads 340 of the back nut subassembly 300. During and after detachment of back nut subassembly 300 from body subassembly 200, inward radial deformation of ferrule 310 against outer conductor 1010 is maintained as shown in FIG. 5. Likewise, electrical and mechanical communication between ferrule 310 and outer conductor 1010 is maintained upon detachment of back nut subassembly 300 from body subassembly 200. In addition, back nut subassembly 300 preferably houses sleeve 315 such that the clamp of at least a portion of outer conductor 1010 between sleeve 315 and ferrule 310 (or at least a portion of the clamped region between sleeve 315 and ferrule 310) is maintained upon detachment of the back nut subassembly 300 from the body subassembly 200. Upon detachment, back nut 325 remains rotatably captivated about cable 1000 and will re-seat against ferrule 310 upon re-installation to body assembly 200.

In preferred embodiments, ferrule 310 is permanently deformed around outer conductor 1010 and back nut subassembly 300 can be repeatedly attached to and detached from body subassembly 200 while still maintaining electrical and mechanical communication and environmental sealing between ferrule 310 and outer conductor 1010. In addition, back nut subassembly 300 preferably houses sleeve 315 and back nut subassembly 300 can be repeatedly attached to and detached from body subassembly 200 while still maintaining the clamp of at least a portion of outer conductor 1010 between sleeve 315 and ferrule 310. As a result, electrical and mechanical communication is maintained between outer conductor 1010 and both ferrule 310 and sleeve 315, allowing sleeve to function as a coaxial outer conductor. An outer conductor path can then be continued via sleeve 315 to body 215 (see, e.g., FIG. 4 showing electrical and mechanical communication between sleeve front end 355 and body 215) and therethrough to equipment port 500.

Figure 6B:
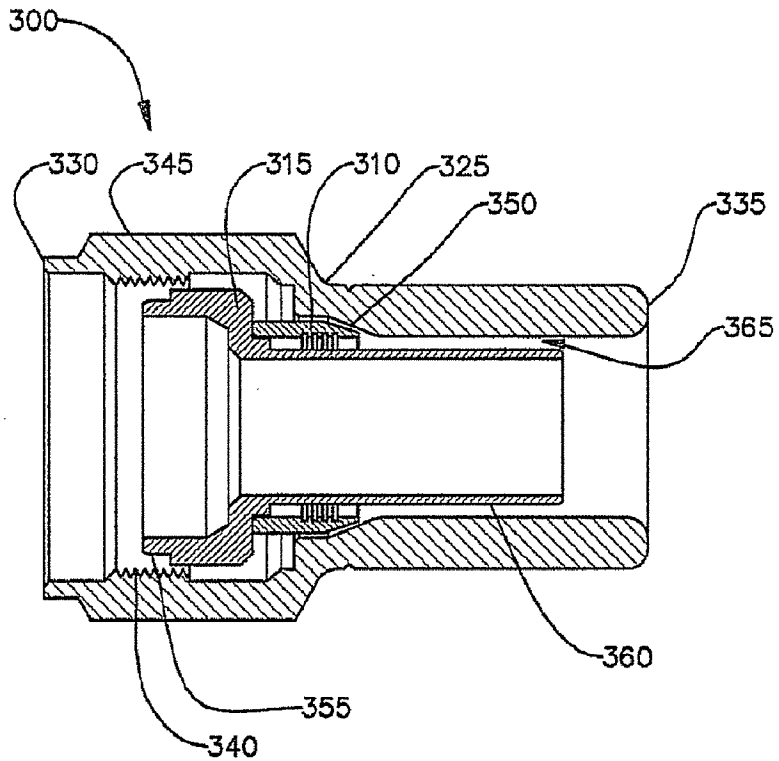
FIGS. 6A and 6B are side cutaway views along the centerline showing optional embodiments of sleeve captivation.
Figure 6A:
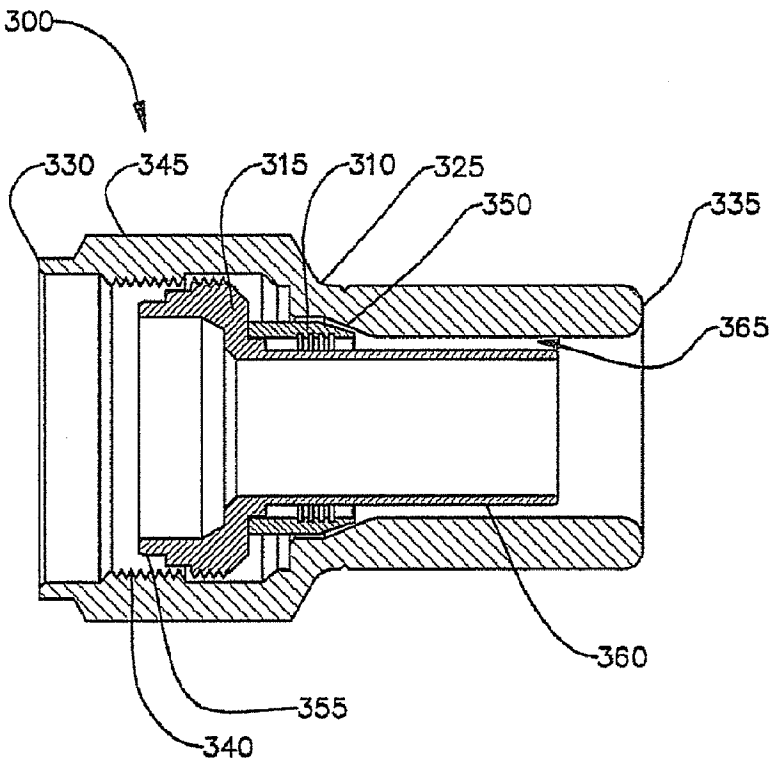

FIGS. 6A and 6B illustrate optional back nut captivation methods. In FIG. 6A, sleeve 315 is axially retained in back nut 325 by means of threading sleeve 315 into back nut 325 until the threaded portion of sleeve 315 has moved beyond the internal thread 340 of back nut 325 in the direction of second end 335 of back nut 325. Once in this position, sleeve 315 is captivated within back nut 325 with limited axial and radial movement permitted. Re-engagement of the corresponding threads is difficult and unlikely, thereby rendering sleeve 315 captivated within back nut 325. In FIG. 6B, an alternate means of component assembly is illustrated, wherein the parts are not retained in respect to one another and are permitted to move as individual components being placed in juxtaposition only at time of final assembly to cable.

Figure 7:
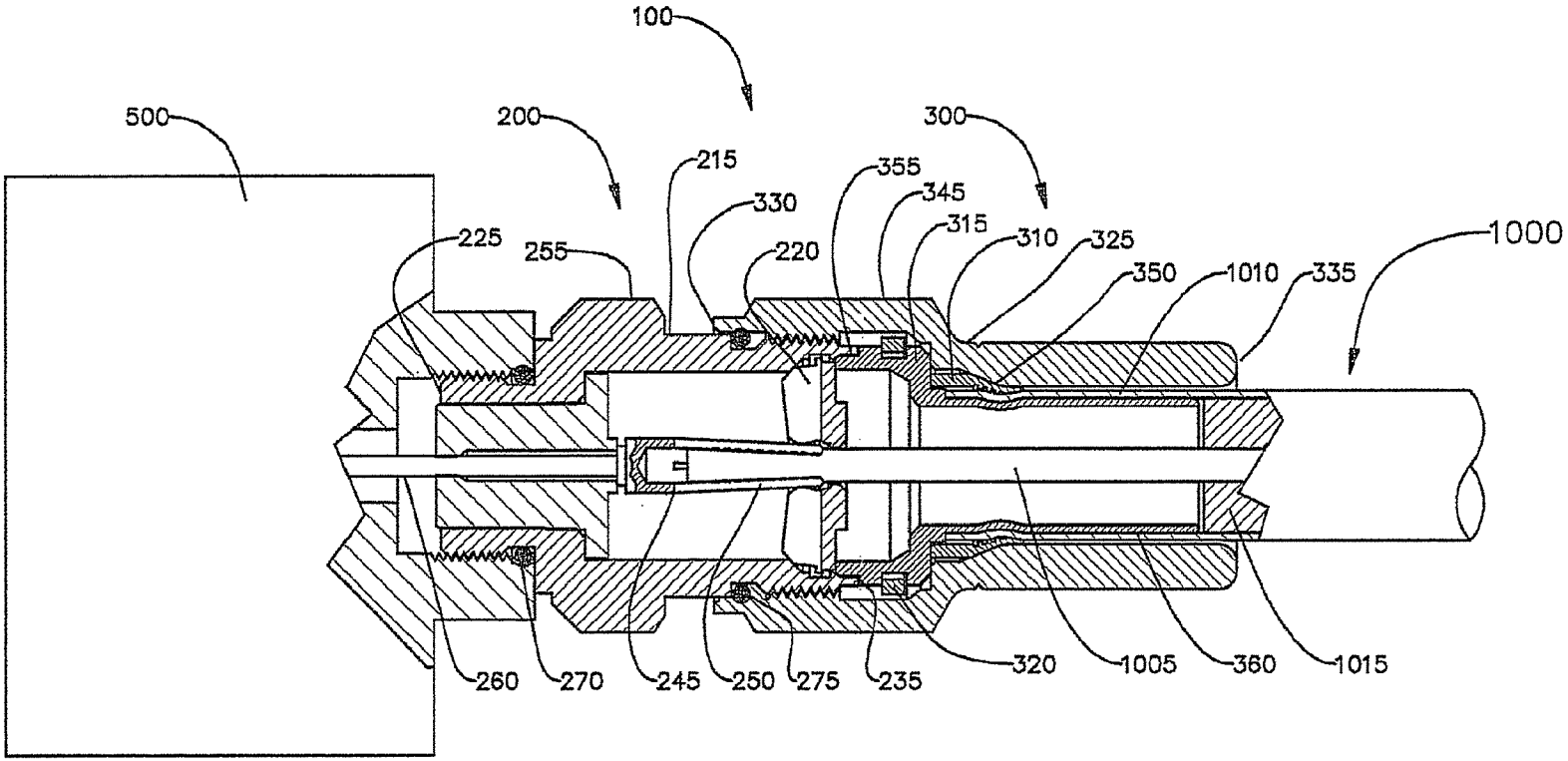
FIG. 7 is a side cutaway view along the centerline of optional embodiments of a connector, as disclosed herein, where greater pressure is exerted on the clamping mechanism, forming a localized annular depression in the cable outer conductor and sleeve.

FIG. 7 is a side cutaway view along the centerline of an optional embodiment where greater pressure is exerted on the clamping mechanism, purposely forming outer conductor 1010 and sleeve 315 in a localized annular depression. In this configuration, ferrule 310 is circumferentially compressed by tapered portion 350 with enough pressure to cause localized annular depressions of both the outer conductor 1010 and the sleeve 315. As a result, resistance to Radio Frequency Interference leakage can be increased by the relatively convoluted path created by the radial deformation and outer conductor retention characteristics can be improved. The variance in impedance match caused by the localized annular depression can be electrically compensated by incorporating internal step features, or, bores (not shown), in sleeve front end 355, and can, thereby, render excellent electrical performance characteristics such as improved Return Loss and reduced Radio Frequency Interference (radiation of signal).

Figure 8:
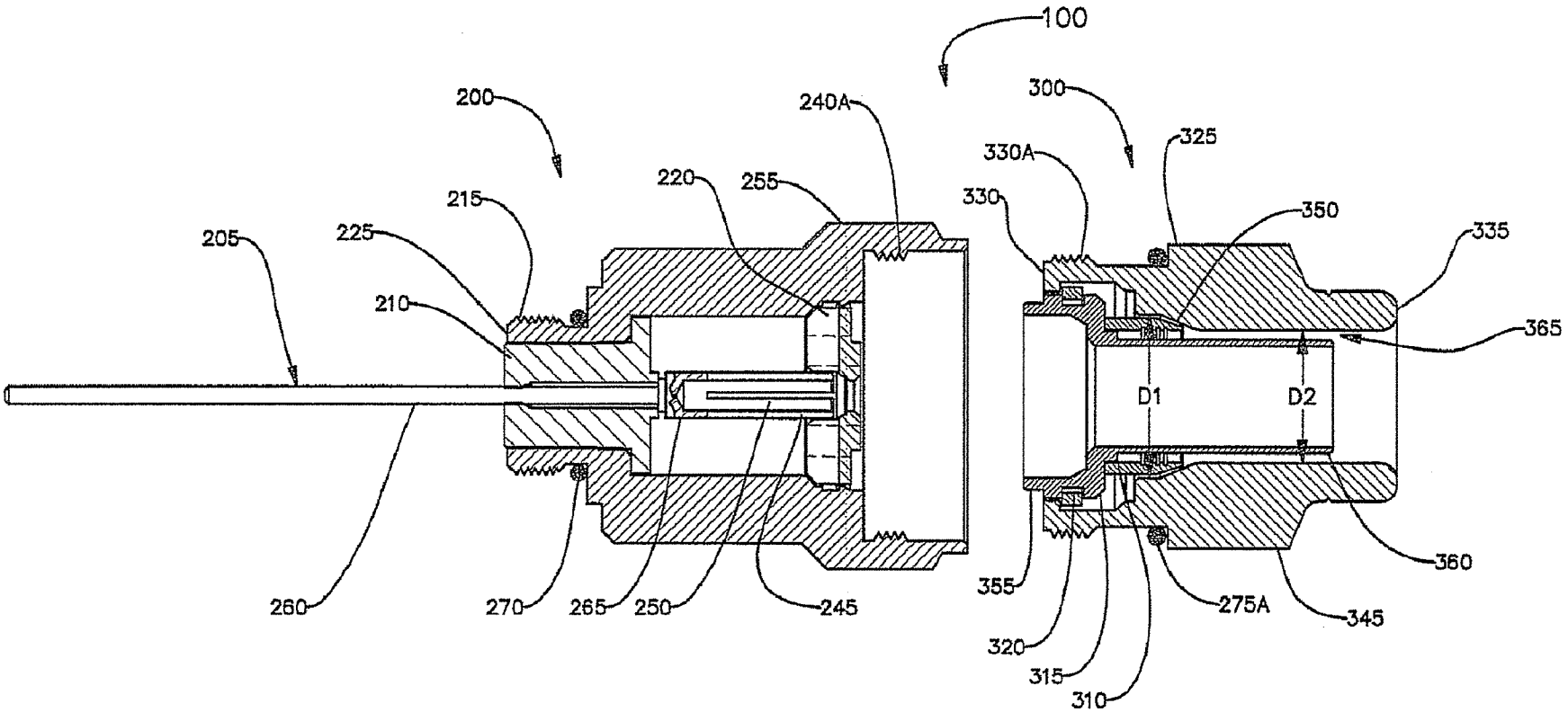
FIG. 8 is a side cutaway view along the centerline of an alternate embodiment of a connector, as disclosed herein, comprising a body subassembly and a back nut subassembly wherein the second end of the body subassembly comprises internal threads and the first end of the back nut subassembly comprises external threads and is illustrated in an uninstalled, separated condition.

FIG. 8 is a side cutaway view along the centerline of an alternate embodiment of a connector, as disclosed herein, comprising body subassembly 200 and back nut subassembly 300 wherein the second end 235 of body subassembly 200 comprises internal threads 240A and the first end 330 of back nut subassembly 300 comprises external threads 330A. Back nut subassembly also optionally includes o-ring 275A.

Figure 9:
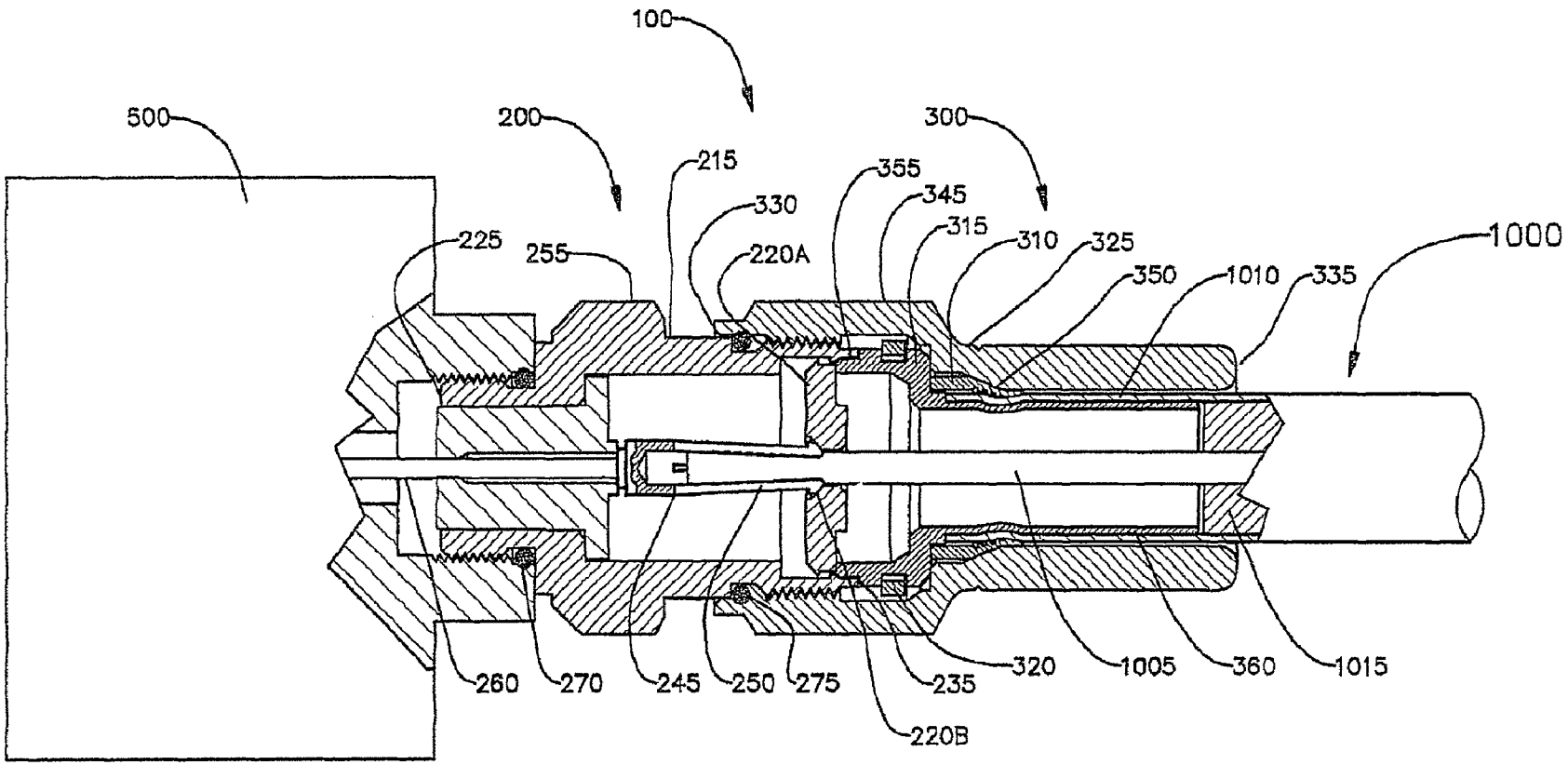
FIG. 9 is a side cutaway view along the centerline of yet another alternate embodiment of a connector, as disclosed herein, comprising a body subassembly and a back nut subassembly wherein the body subassembly comprises an alternative method for closing, or activating, the connector center contact mechanism.

FIG. 9 is a side cutaway view along the centerline of yet another alternate embodiment of a connector comprising a body subassembly 200 and back nut subassembly 300 wherein body subassembly 200 comprises an alternative method for closing, or activating, connector center contact mechanism. Coaxial cable center conductor 1005 is received in socket contact 245. Axial advancement of sleeve 315 toward optional embodiment actuator 220A causes actuator 220A to drive forward within body subassembly 200. Forward movement of actuator 220A causes angled portion 220B of contact 245 to drive cantilevered tines 250 radially inward against center conductor 1005.

Figure 10:
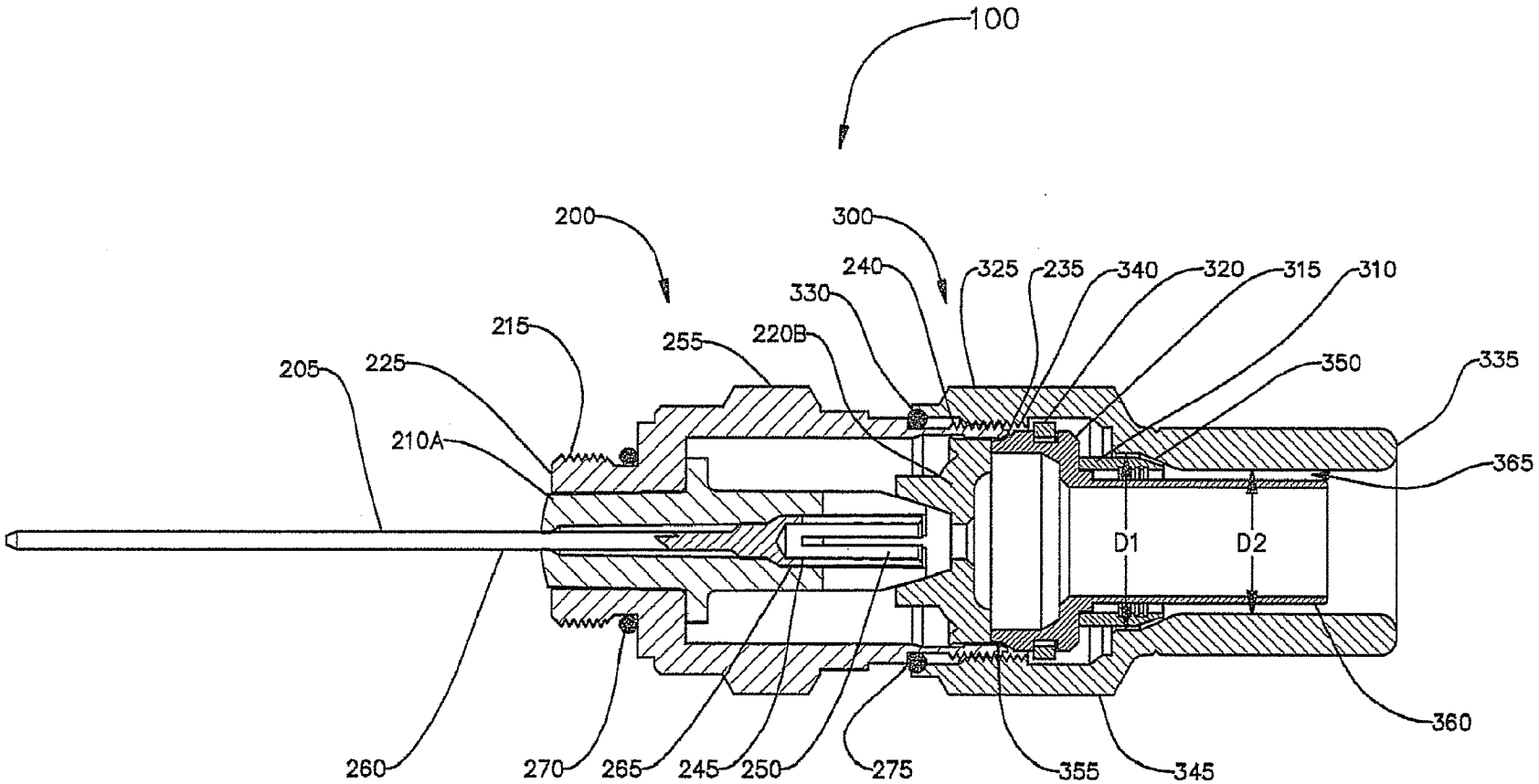
FIG. 10 is a side cutaway view along the centerline of yet another alternate embodiment of a connector, as disclosed herein, comprising a body subassembly and a back nut subassembly wherein the body subassembly comprises still another alternative method for closing, or activating, the connector center contact mechanism.

FIG. 10 is a side cutaway view along the centerline of yet another alternate embodiment of a connector comprising a body subassembly 200 and back nut subassembly 300 wherein body subassembly 200 comprises yet an alternative method for closing, or activating, connector center contact mechanism. Coaxial cable center conductor 1005 is received in socket contact 245. Axial advancement of sleeve 315 toward optional embodiment actuator 220B causes actuator 220B to drive forward within body subassembly 200 linearly and radially against slotted insulator 210A. Forward movement of actuator 220B causes angled portion of slotted insulator 210A to, in turn, drive cantilevered tines 250 of contact 245 radially inward against center conductor 1005.

Figure 11:
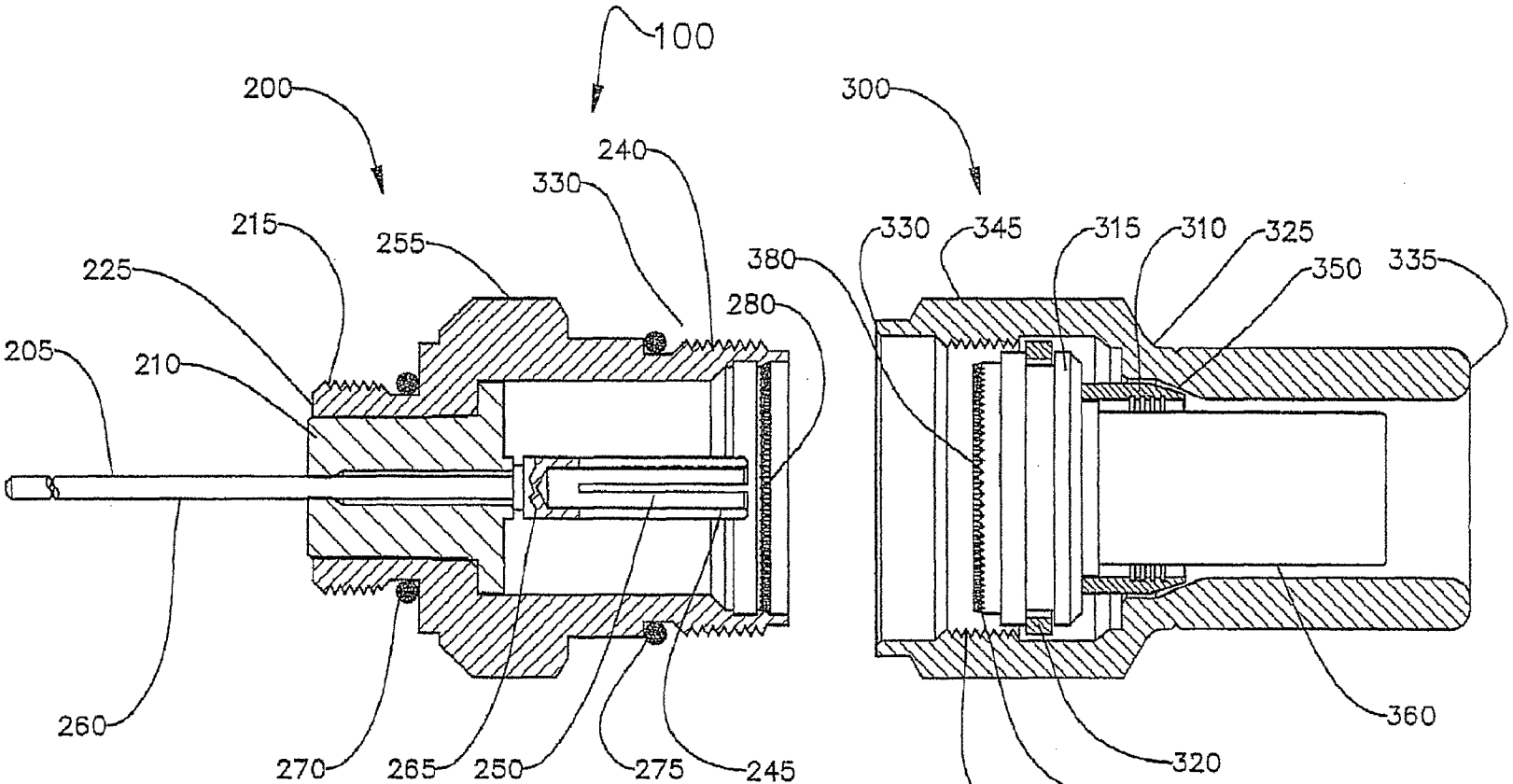
FIG. 11 is a partial side cutaway view along the centerline of a preferred embodiment in an unmated condition of a connector illustrating an anti-rotation feature.

FIG. 11 is a partial side cutaway view along the centerline of a preferred embodiment of a connector in an unmated condition illustrating an anti-rotation feature (in FIG. 11, actuator 220 is not shown for clarity). Sleeve 315 comprises conically knurled portion 380 and body 215 comprises corresponding knurled, embossed or indented portion 280.

Figure 12:
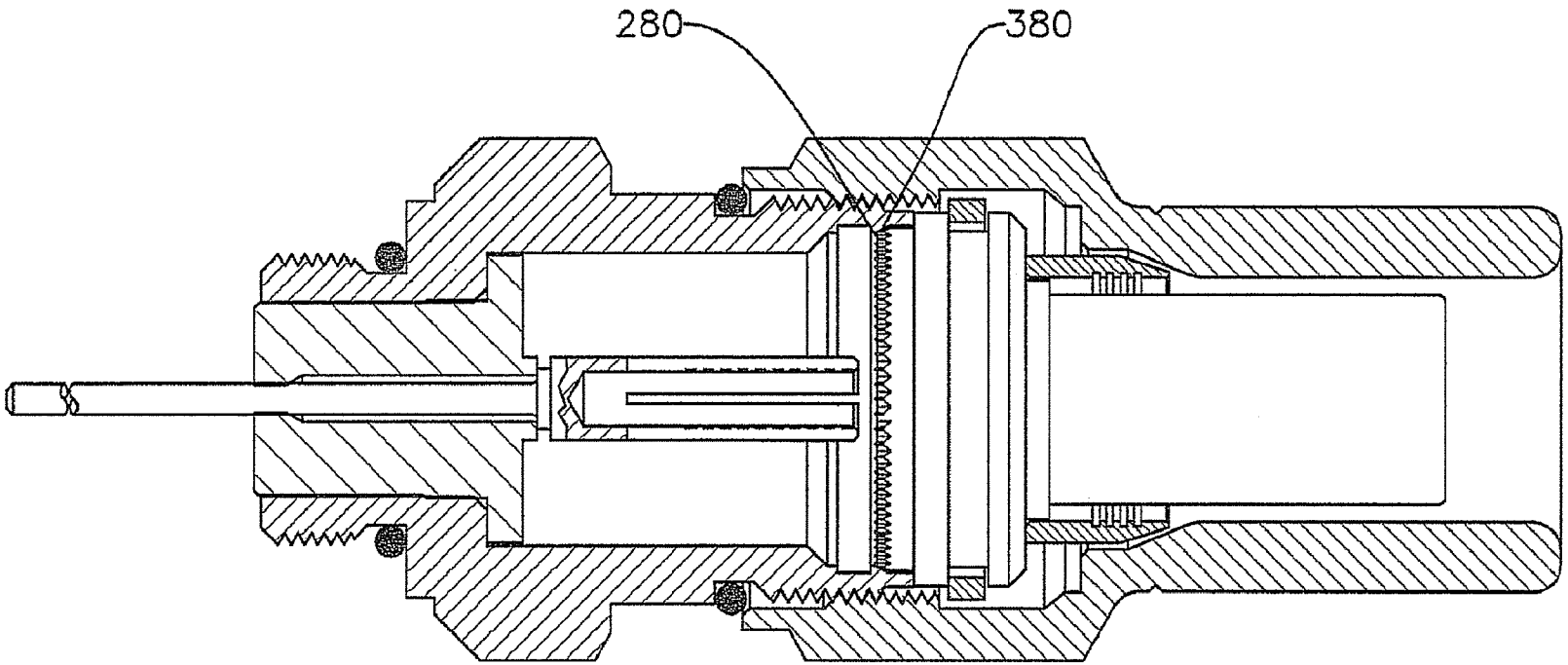
FIG. 12 is a partial side cutaway view along the centerline of a preferred embodiment in a partially mated condition of a connector illustrating an anti-rotation feature.

FIG. 12 is a partial side cutaway view along the centerline of the connector of FIG. 11 in a partially mated condition wherein conically knurled portion 380 of sleeve 315 engages indented portion 280 of body 215 similar to male and female splines on a shaft providing resistance to rotative forces applied by back nut 325, ferrule 310 and cable outer conductor 1010 during tightening.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A hardline coaxial cable connector for coupling a coaxial cable having a center conductor, an insulative layer, and an outer conductor to an equipment port, the connector comprising:

a body subassembly having a first end and a second end, the first end adapted to connect to an equipment port and the second end having internal or external threads;

a detachable back nut subassembly having a first end, a second end, and an inner surface, the first end having threads that mate with the internal or external threads on said second end of said body subassembly and the second end adapted to receive a prepared end of a coaxial cable; and a deformable ferrule disposed within said back nut subassembly;

wherein the back nut subassembly is rotatable with respect to a coaxial cable inserted therein and the inner surface of the back nut subassembly comprises a tapered portion that decreases from a first diameter between the tapered portion and the first end of the back nut subassembly to a second diameter between the tapered portion and a second end of the back nut subassembly such that as the back nut subassembly is advanced axially toward the body subassembly as a result of the mating of the internal or external threads of the body subassembly with the threads of the back nut subassembly and rotating the back nut subassembly relative to the body subassembly, the tapered portion contacts the deformable ferrule and causes at least a portion of the ferrule to deform radially inwardly establishing a gripping and sealing relationship between the ferrule and the outer conductor thereby providing electrical and mechanical communication between the ferrule and the outer conductor and wherein, upon detachment of the back nut subassembly from the body subassembly, at least a portion of the clamped region between the sleeve and the ferrule is maintained such that back nut subassembly remains rotatably captivated about coaxial cable; and the back nut subassembly is capable of being repeatedly attached and detached from the body subassembly while still maintaining the electrical and mechanical communication and environmental sealing between the ferrule and the outer conductor.

2. The hardline coaxial cable connector of claim 1, wherein the ferrule is adapted to deform radially inwardly against the outer conductor of a coaxial cable inserted into the second end of the back nut subassembly in order to provide electrical and mechanical communication between said ferrule and said outer conductor.

3. The hardline coaxial cable connector of claim 2, wherein the electrical and mechanical communication between said ferrule and said outer conductor is maintained upon detachment of the back nut subassembly from the body subassembly.

4. The hardline coaxial cable connector of claim 1, wherein the connector further comprises a sleeve disposed within said back nut subassembly.

5. The hardline coaxial cable connector of claim 4, wherein the ferrule is adapted to deform radially inwardly against the outer conductor of a coaxial cable inserted into the second end of the back nut subassembly, wherein at least a portion of the outer conductor is inserted between an outer diameter of the sleeve and an inner diameter of the ferrule, such that as the ferrule deforms radially inwardly against the outer conductor, at least a portion of the outer conductor is clamped between the sleeve and the ferrule.

6. The hardline coaxial connector of claim 5, wherein the ferrule is adapted to cause a localized annular depression of the outer conductor and sleeve where at least a portion of the outer conductor is clamped between the sleeve and the ferrule.

7. The hardline coaxial cable connector of claim 1, wherein the body subassembly houses a conductive pin, said conductive pin having a front end for connecting to said equipment port and a back end, said back end comprising a socket contact for receiving the center conductor of a coaxial cable, said socket contact comprising a plurality of cantilevered tines.

8. The hardline coaxial cable connector of claim 7, wherein the connector further comprises an actuator disposed within said body subassembly.

9. The hardline coaxial cable connector of claim 8, wherein the connector further comprises a sleeve disposed within said back nut subassembly and wherein axial advancement of the sleeve toward the actuator causes the actuator to drive the cantilevered tines radially inwardly against the center conductor of a coaxial cable inserted into the socket contact.

10. A method of coupling a hardline coaxial cable having a center conductor, an insulative layer, and an outer conductor to an equipment port, the method comprising:

providing a hardline coaxial cable connector comprising:

a body subassembly having a first end and a second end, the first end adapted to connect to the equipment port and the second end having internal or external threads;

a detachable back nut subassembly having a first end, a second end, and an inner surface, the first end having threads that mate with the internal or external threads on said second end of said body subassembly and the second end adapted to receive a prepared end of a coaxial cable; and a deformable ferrule disposed within said back nut subassembly;

connecting the first end of the body subassembly to the equipment port;

inserting the prepared end of a coaxial cable into the second end of the removable back nut subassembly; and rotating the back nut subassembly relative to the coaxial cable and the body subassembly such that the back nut subassembly is advanced axially toward the body subassembly as a result of the mating of the internal or external threads of the body subassembly with the threads of the back nut subassembly; wherein the inner surface of the back nut subassembly comprises a tapered portion that decreases from a first diameter between the tapered portion and the first end of the back nut subassembly to a second diameter between the tapered portion and a second end of the back nut subassembly such that as the back nut subassembly is advanced axially toward the body subassembly, the tapered portion contacts the deformable ferrule and causes at least a portion of the ferrule to deform radially inwardly against the outer conductor of the coaxial cable in order to provide electrical and mechanical communication between said ferrule and said outer conductor.

11. The method of claim 10, wherein the method further comprises detaching the back nut subassembly from the body subassembly prior to connecting the first end of the body subassembly to the equipment port and then reattaching the back nut subassembly to the body subassembly subsequent to inserting the prepared end of the coaxial cable into the second end of the back nut subassembly.

12. The method of claim 10, wherein the connector further comprises a sleeve disposed within said back nut subassembly.

13. The method of claim 12, wherein at least a portion of the outer conductor is inserted between an outer diameter of the sleeve and an inner diameter of the ferrule, such that as the ferrule deforms radially inwardly against the outer conductor, at least a portion of the outer conductor is clamped between the sleeve and the ferrule.

14. The method of claim 13, wherein the ferrule causes a localized annular depression of the outer conductor and sleeve where at least a portion of the outer conductor is clamped between the sleeve and the ferrule.

15. The method of claim 10, wherein the body subassembly houses a conductive pin, said conductive pin having a front end for connecting to said equipment port and a back end, said back end comprising a socket contact for receiving the center conductor of a coaxial cable, said socket contact comprising a plurality of cantilevered tines.

16. The method of claim 15, wherein the connector further comprises an actuator disposed within said body subassembly and a sleeve disposed within said back nut subassembly and wherein axial advancement of the sleeve toward the actuator causes the actuator to drive the cantilevered tines radially inwardly against the center conductor of a coaxial cable inserted into the socket contact.

17. A method of coupling and decoupling a hardline coaxial cable having a center conductor, an insulative layer, and an outer conductor to an equipment port, the method comprising:

performing the method of claim 10 to couple the coaxial cable to the equipment port; and detaching the back nut subassembly from the body subassembly by rotating the back nut subassembly relative to the coaxial cable and the body subassembly such that the back nut subassembly is advanced axially away from the body subassembly as a result of the mating of the internal or external threads of the body subassembly with the threads of the back nut subassembly;

wherein the electrical and mechanical communication between said ferrule and said outer conductor is maintained upon detachment of the back nut subassembly from the body subassembly.

18. The method of claim 17 wherein the connector further comprises a sleeve disposed within said back nut subassembly.

19. The method of claim 18, wherein at least a portion of the outer conductor is inserted between an outer diameter of the sleeve and an inner diameter of the ferrule, such that as the ferrule deforms radially inwardly against the outer conductor, at least a portion of the outer conductor is clamped between the sleeve and the ferrule and wherein the clamp of at least a portion of the outer conductor between the sleeve and the ferrule is maintained upon detachment of the back nut subassembly from the body subassembly.

* * * * *